United States Patent [19]

Liedel

[11] 3,999,381

[45] Dec. 28, 1976

[54] POSITION CONTROL OF JET PIPE IN MISSILE ATTITUDE CONTROL SYSTEM

[75] Inventor: Ronald J. Liedel, Huntsville, Ala.

[73] Assignee: The United States of America as represented by the Secretary of the Army, Washington, D.C.

[22] Filed: Apr. 17, 1975

[21] Appl. No.: 569,033

[52] U.S. Cl. ..... 60/229; 239/265.19; 137/83

[51] Int. Cl.[2] ..... F02K 1/00

[58] Field of Search ..... 60/230, 231, 228, 229, 60/232; 239/265.23, 265.19, 446; 137/83

[56] References Cited

UNITED STATES PATENTS

| | | | |
|---|---|---|---|
| 2,341,644 | 2/1944 | Moller et al. | 137/83 |
| 2,392,300 | 1/1946 | Ziebolz et al. | 137/83 X |
| 3,239,150 | 4/1966 | Chisel | 239/265.23 |
| 3,285,262 | 11/1966 | Ernst et al. | 60/231 X |
| 3,606,902 | 9/1971 | Shinn et al. | 137/83 |

FOREIGN PATENTS OR APPLICATIONS

| | | | |
|---|---|---|---|
| 1,278,782 | 11/1961 | France | 60/229 |

*Primary Examiner*—Carlton R. Croyle
*Assistant Examiner*—Thomas I. Ross
*Attorney, Agent, or Firm*—Nathan Edelberg; Robert P. Gibson; Harold W. Hilton

[57] ABSTRACT

A pure fluid interface device for proportional linear control of high temperature, high pressure, hot gas flow from the exhaust of a rocket motor. The interface device receives the hot gas by direct bleeding from the rocket exhaust system and directs the gas to the control system of a missile airframe.

The proportional linear control of the interface is achieved through a pair of positive displacement pistons which engage a jet pipe, charged with the hot gas, for pivotal movement of the jet pipe for alignment of the orifice of the jet pipe with one or both exit ports in the body of the interface device to direct the hot gas through the desired exit port.

2 Claims, 3 Drawing Figures

POSITION CONTROL OF JET PIPE IN MISSILE ATTITUDE CONTROL SYSTEM

DEDICATORY CLAUSE

The invention described herein may be manufactured, used, and licensed by or for the Government for governmental purposes without the payment to me of any royalties thereon.

BACKGROUND OF THE INVENTION

A purely fluidic pitch and yaw control system, which is charged by a direct bleed from the exhaust of the rocket motor, requires an interface from the gyro and fluidic amplifier to achieve the desired degree of linear proportional output to the airframe control means for control of the pitch and yaw of the missile.

SUMMARY OF THE INVENTION

An interface device disposed intermediate the gyro-fluidic amplifier of a missile control system and the thruster system to direct, in proportional manner, a portion of the exhaust gases from the missile motor to the thruster system of the missile to achieve pitch and yaw control of the missile. The interface device includes a body having a high pressure chamber having a pair of control ports on opposite sides thereof. The control ports communicate into the high pressure chamber and each port carries a spring biased piston therein. Each piston is provided with piston rods extending into the high pressure chamber. The body includes an inlet port in communication with the exhaust gases of the missile motors. A pair of exit ports are disposed in the body on the opposite side from the inlet port. The exit ports are in communication with the high pressure chamber and the opposite sides of the body. A pivotally mounted jet pipe is secured in the high pressure chamber between the ends of the piston rods. The jet pipe has an orifice therethrough for communication with the inlet and both outlet ports when no control signal is applied to either piston. Application of a control force against either piston effects pivotal movement of the jet pipe to direct the hot gas through the orifice thereof and through a predetermined outlet of the interface device.

DESCRIPTION OF THE PREFERRED EMBODIMENT

Figure 1:
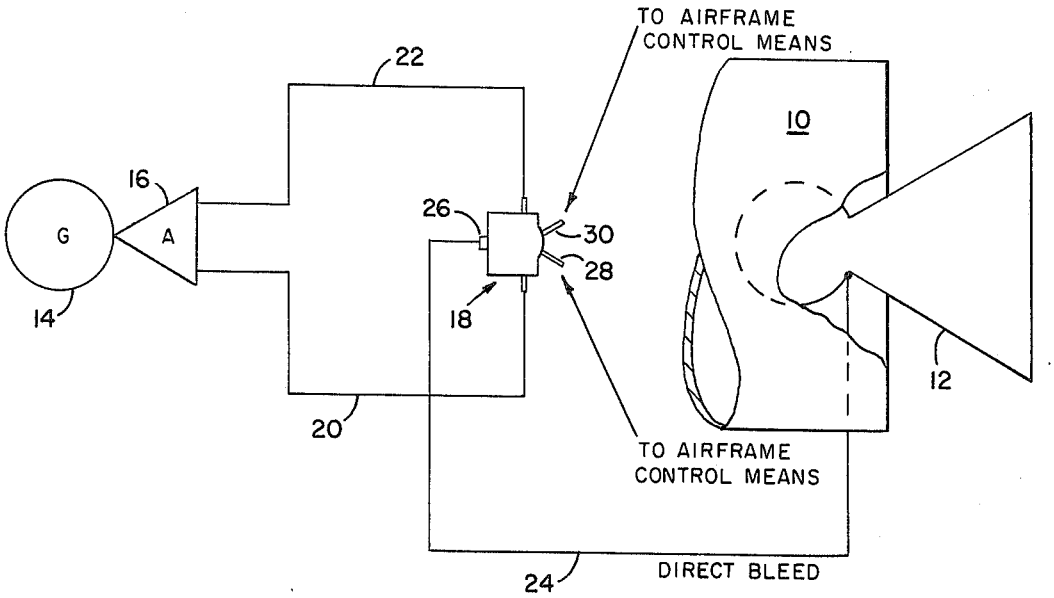
FIG. 1 is a diagrammatic view of the pure fluid pitch and yaw control system of the present invention.

As shown in FIG. 1 a missile 10 includes a motor 12 for generating and expelling thrust producing gases therefrom. The missile utilizes a pure fluidic control system comprised of a gyro 14, and a fluid amplifier 16 for fluidically amplifying the gyro heading pickoffs, which are fed to an interface device 18 through right and left channels 20 and 22, respectively. A direct bleed line 24 connects interface device 18 with rocket motor 12 and serves to feed a portion of the exhaust gases to the inlet 26 of interface device 18. A pair of exit ports 28 and 30 subsequently feeds the hot gas to the airframe control means for pitch and yaw control of the missile as described hereinbelow.

Figure 2:
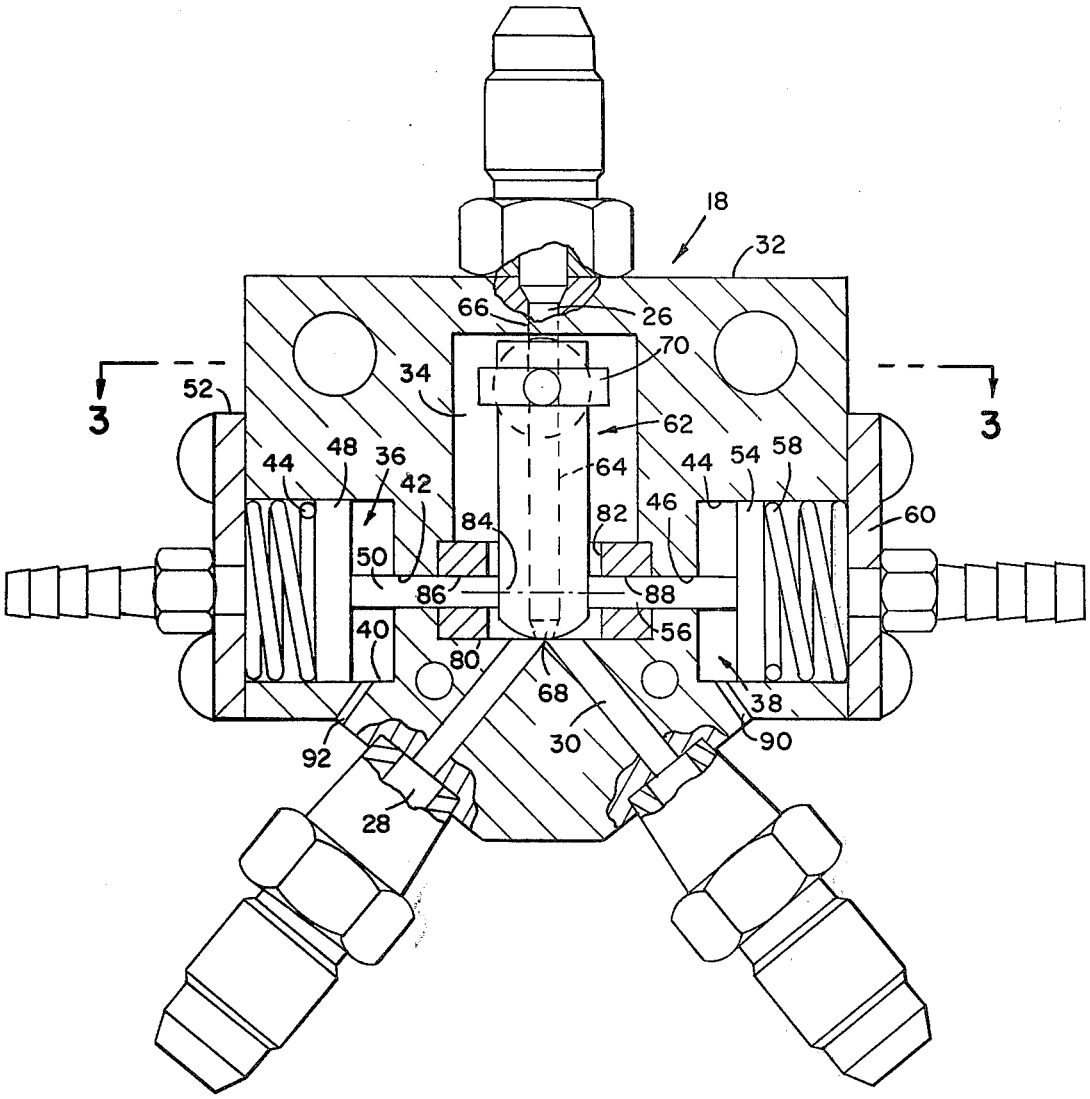
FIG. 2 is an elevational view, partially in section, of the interface device of FIG. 1.

As more clearly shown in FIG. 2, the interface device 18 includes a body 32 having the inlet 26 at one end thereof in communication with a high pressure chamber 34 in body 32. The pair of exit ports 28 and 30 are disposed through the body on the opposite side of the high pressure chamber in communication therewith. A pair of control ports 36 and 38 are disposed in the body in transverse relation to the high pressure chamber. Control port 36 includes a larger diameter portion 40 and a smaller diameter portion 42. Control port 38 includes a larger diameter portion 44 and a smaller diameter portion 46. Each control port communicates with the high pressure chamber and the exterior of the body.

A first piston 48 is carried in control chamber 36 and includes a piston rod 50 extending through smaller opening 42 of control chamber 36. A first compression spring 44 is carried in larger portion 40 of chamber 36 and is secured therein by a plate 52 secured to body 32.

A second piston 54 is carried in control chamber 38 and includes a piston rod 56 extending through smaller opening 46 of control chamber 38. A second compression spring 58 is carried in the larger diameter portion 44 of chamber 38 and is secured therein by a plate 60 secured to body 32.

A jet pipe 62 is pivotally secured in high pressure chamber 34 and extends across the length of the chamber. Jet pipe 62 includes an orifice 64 extending therethrough. Orifice 64 includes an upper portion 66 in communication with inlet 26 of body 32 and a lower, smaller diameter portion 68 in equal alignment with exit ports 28 and 30 of body 18 when the jet pipe is in its central position.

Figure 3:
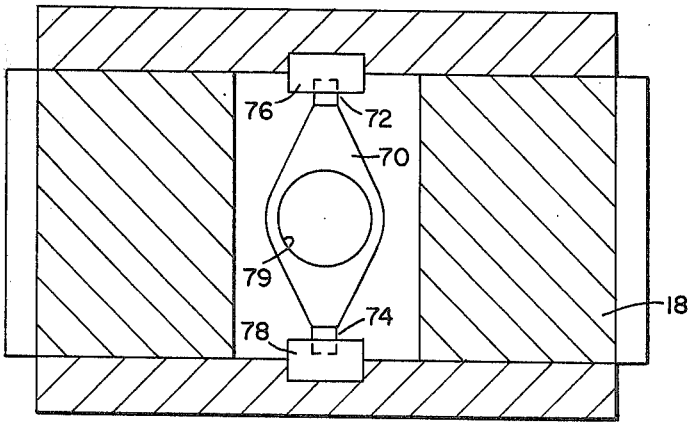
FIG. 3 is a sectional view taken along line 3—3 of FIG. 2.

To pivotally secure the jet pipe 62 in high pressure chamber 34, a jet pipe pivot mounting member 70 (FIG. 3) includes a pair of annular end portions 72 and 74 secured in pivot bearing support members 76 and 78, respectively. Support members 76 and 78 are secured in body 32 on opposite sides of the high pressure chamber 34. Jet pipe 62 is secured in a central opening 79 in member 70.

To serve as a guide for piston rods 50 and 56 and as an aligner for jet pipe 62, a jet pipe alignment member 80 is secured in high pressure chamber 34 adjacent exit ports 28 and 30. Alignment member 80 includes a central opening 82 therethrough to receive the lower end 84 of jet pipe 62 therein. A first opening 86, transverse to central opening 82, is provided through alignment member 80 in communication with central opening 82 thereof and the smaller opening 42 of chamber 36. Piston rod 50 extends through opening 42 and opening 86 for mating engagement with lower portion 84 of jet pipe 62.

A second opening 88, transverse to central opening 82, is provided through alignment member 80 in communication with central opening 82 thereof and the smaller opening 46 of chamber 38. Piston rod 56 extends through opening 46 and opening 88 for mating engagement with lower portion 84 of jet pipe 62.

Springs 44 and 58 are matched linear springs which are disposed for providing a force proportional to the input signal from the gyro 14 and fluid amplifier 16, resulting in a null (zero resultant force) position of the jet pipe which is determined by the amplitude of the input signal.

In operation, a direct bleed from the rocket motor 12 is injected into interface device 18 through inlet 26 to charge the jet pipe with gas. A pressure drop is obtained through the jet pipe at the bottom orifice 68. The jet pipe maintains an equal hot gas flow between exit ports 28 and 30 by remaining in the central position in the high pressure chamber 34 through the force of springs 44 and 58 on pistons 48 and 54, respectively. When a fluidic pressure which is slightly greater or less than the force exerted by the springs on the pistons is sent from fluid amplifier 16 to one of the control ports 36 or 38 a proportional linear displacement of the jet pipe is achieved through the linear springs 44 and 58, porting a differential, linear, proportional high pressure exit pressure and flow through the two output ports 28 and 30, since the control signal was only of sufficient force to move the jet pipe slightly to maintain the orifice slightly in registry with one orifice and more in registry with the second orifice.

A full over signal from fluid amplifier 16 produces a full over slew of jet pipe 62 porting the full flow of hot gas through either output channel 28 or 30. Back pressure is eliminated from control chambers 36 and 38 by means of a pair of small ports 90 and 92, respectively, communicating with the control chambers 36 and 38 and the atmosphere. The ports 90 and 92 also vents hot gas leaks through the piston rod guides 42 and 46. At hard over conditions slew of the jet pipe is prevented from being excessive through the sized slot 82 in alignment member 80. Friction is minimized in the pistons 48 and 54, rods 50 and 56, jet pipe 62, pivot member 70, jet pipe guide 80 by using Kel-F or Teflon for their fabrication.

It is to be understood that the airframe control means which are actuated by the interface device may be fluidic amplifiers disposed about the nozzle of the rocket motor utilizing secondary injection principles to divert exhaust gas flow from the nozzle to achieve pitch or yaw control of the missile, or, if desired, vanes may be actuated by the interface device to achieve the desired control.

I claim:

1. In a fluidic attitude control system for a missile having airframe control means actuated by exhaust gases from the motor of said missile, interface means for directing and controlling flow of said exhaust gases to said airframe control means for attitude control of said missile comprising:

a. a body having a high pressure chamber therein, an inlet and a pair of outlets disposed in communication with said high pressure chamber, said inlet connected to said motor of said missile to receive exhaust gases therefrom, and, a pair of control chambers communicating with the exterior of said body and opposite sides of said high pressure chamber;

b. a jet pipe mounted in said chamber and having an orifice longitudinally therethrough, said jet pipe being pivotally mounted for movement from a first central null position to any desired position between second and third extreme opposite positions;

c. means for pivoting said jet pipe for movement thereof for alignment of said orifice with said exit ports for flow of said exhaust gas therethrough, said flow being proportionate to the amount of displacement of said jet pipe, said means for pivoting said jet pipe including first and second pistons mounted in said control chambers on opposite sides of said high pressure chamber, each of said pistons having a piston rod extending therefrom in engagement with said jet pipe on opposite sides thereof, and control signal means for proportionally displacing said pistons for movement of said jet pipe corresponding to the magnitude of said control signal;

d. first and second matched springs carried in said body, the first of said matched spring being mounted in a first of said control chambers in abutting relation with the first said piston, the second of said matched spring being mounted in the second of said pair of control chambers in abutting relation with the second said piston; and, e. alignment means disposed in said high pressure chamber for aligning said jet pipe in said body and for limiting movement thereof between said second and third positions, said alignment means being an annular member having a central opening therein to receive the lower end of said jet pipe and having a pair of transverse openings therethrough communicating with said central opening, said piston rods disposed for extending through said transverse openings for the engagement with said jet pipe.

2. Apparatus as in claim 1 including venting means communicating with the atmosphere and each control chamber for preventing back pressure therein.

* * * * *